United States Patent [19]

Frank et al.

[11] Patent Number: 4,533,852

[45] Date of Patent: Aug. 6, 1985

[54] METHOD OF MANUFACTURING A THERMIONIC CATHODE AND THERMIONIC CATHODE MANUFACTURED BY MEANS OF SAID METHOD

[75] Inventors: Berthold Frank; Georg Gärtner, both of Aachen; Hans Lydtin, Stolberg, all of Fed. Rep. of Germany

[73] Assignee: U.S. Philips Corporation, New York, N.Y.

[21] Appl. No.: 447,079

[22] Filed: Dec. 6, 1982

[30] Foreign Application Priority Data

Dec. 8, 1981 [DE] Fed. Rep. of Germany ..... 3148441

[51] Int. Cl.[3] ..... H01J 1/28; H01J 1/13

[52] U.S. Cl. ..... 313/346 DC; 313/352; 313/355; 313/292; 445/50; 445/51

[58] Field of Search ..... 313/346 DC, 346 R, 352, 313/355, 292; 445/49, 50, 51

[56] References Cited

U.S. PATENT DOCUMENTS

| | | | |
|---|---|---|---|
| 2,843,517 | 7/1958 | Kerstetter et al. | 445/51 X |
| 3,159,461 | 12/1964 | MacNair | 313/346 DC |
| 3,488,549 | 1/1970 | Amra | 313/346 R |
| 3,558,966 | 1/1971 | Hill et al. | 313/346 R |
| 4,275,123 | 6/1981 | Buxbaum et al. | 313/346 R X |

FOREIGN PATENT DOCUMENTS

| | | | |
|---|---|---|---|
| 0056749 | 7/1982 | European Pat. Off. | 346 R/ |
| 2475796 | 8/1981 | France | 313/346 R |

*Primary Examiner*—David K. Moore
*Assistant Examiner*—Vincent DeLuca
*Attorney, Agent, or Firm*—Norman N. Spain

[57] ABSTRACT

The cathode (4) the material of which is substantially high-melting metal such as W, Mo, Ta, Nb, Re and/or C, consists of a very fine-grained mechanically stable support layer (5), a series of layers (6) considerably enriched with emissive material, in general from the scandium group especially from the group of rare earth metals, preferably with Th or compounds thereof and a thermally stable preferentially oriented coating layer (7). All the layers are provided via the gaseous phase, for example, CVD methods, on a substrate (1) formed according to the desired cathode geometry. The substrate (1) is removed after termination of the deposition. FIG. 2.

30 Claims, 9 Drawing Figures

Figure 1:
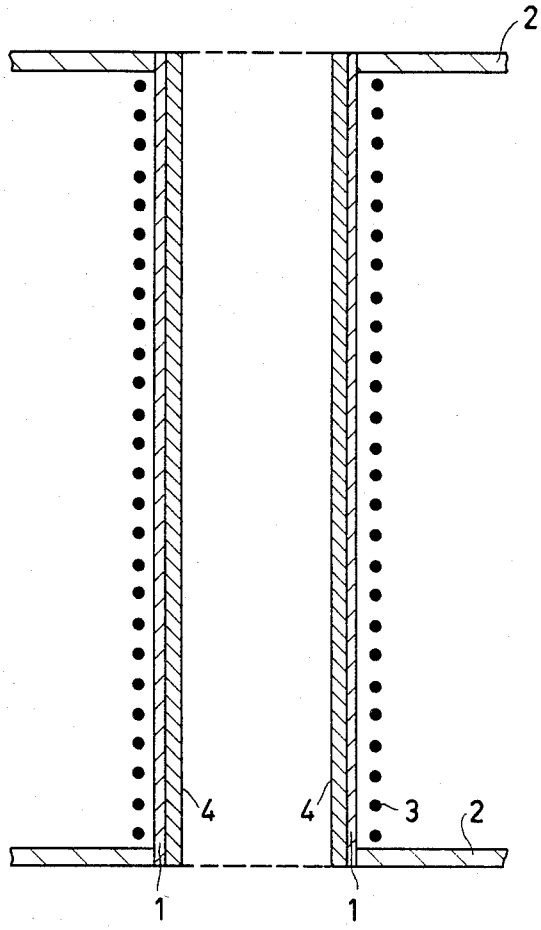

METHOD OF MANUFACTURING A THERMIONIC CATHODE AND THERMIONIC CATHODE MANUFACTURED BY MEANS OF SAID METHOD

The invention relates to a method of manufacturing a thermionic cathode having a polycrystalline coating layer of a high-melting-point metal which is deposited on the underlying layers.

The invention also relates to a thermionic cathode manufactured by means of said method.

Examples of high-melting-point metals are W, Mo, Ta, Nb, Re, Hf, Ir, Os, Pt, Rh, Ru, Th, Ti, V, yb or Zr.

Such a method is known from German Offenlegungsschrift No. 14 39 890.

A survey of the most important types of thermionic monolayer cathodes and the operation thereof is described in Vacuum 19 (1966) 353–359. The problems relating to high power cathodes for UHF tubes are discussed in some detail in German Auslegeschrift No. 24 15 384 especially with respect to the previously employed mesh cathodes. From the last reference the conclusion may be drawn but that cylindrical unipotential cathodes are the ideal cathodes for UHF tubes, if the emitting system chosen already satisfies the remaining peripheral conditions when used in high frequency tubes.

In order to avoid the problems with respect to emission and parasitic impedance in the previously employed thoriated mesh cathodes, directly heated unipotential cathodes for electron tubes having a coaxial construction of the electrodes are described in German Offenlegungsschrift No. 27 32 960 and later in German Auslegeschrift No. 28 38 020, said cathodes consisting of a hollow cylinder of pyrolytic graphite and a thin metal layer as an emission layer, the thin metal layer consisting of tungsten carbide and thorium and thorium oxide, respectively. In one of the methods intended for the manufacture of such a cathode tungsten+thorium are deposited from the gaseous phase on the hollow cylinder of pyrolytic graphite. Such layers manufactured by Chemical Vapour Deposition (CVD method) will hereinafter also be referred to as "CVD layers".

It has been found, however, that thermionic cathodes having a carrier of pyrolytic graphite and an electron emissive member provided thereon present problems in three respects and are not particularly suitable for commercial application.

The main problem is caused by the different coefficients of thermal expansion of the carrier and of the emissive cathode part. For example, pyrolytic graphite in a direction denoted by a-direction has a linear coefficient of thermal expansion of $10^{-6}K^{-1}$ with respect to the layer construction thereof. In the c-direction at right angles thereto on the contrary it is 20 to $30\times10^{-6}K^{-1}$, while for tungsten it is $4.5\times10^{-6}K^{-1}$ and for thorium $12\times10^{-6}K^{-1}$. With the large temperature differences to which the cathodes are subjected during operation this leads to a partial separation of the emissive cathode part from the supporting base. A bonding layer between the support and emissive cathode part in which, for example, the coefficient of thermal expansion is an average value of the coefficients of the substrate and of the emissive cathode part, does not produce a bond at the usual operating temperatures of 2000 K.

The second disadvantage is the diffusion of carbon into the crystalline structure of the emissive cathode part against which there are no suitable diffusion barriers at a temperature of 2000° K. In a cathode having a support of pyrolytic graphite and an emissive cathode part of thoriated tungsten, tungsten carbide is formed ($W_2C$ and WC) which because of different coefficients of expansion again causes layer separation. Thirdly, thorium carbide (ThC) is formed which, for example, settles along the grain boundaries of the tungsten crystals and clogs the diffusion paths of thorium to the emitting surface. As a result of this, the diffusion of thorium to the surface necessary for the continuous dispensing to the monoatomic thorium layer of the emissive surface is interrupted so that the emission current density is considerably reduced. Therefore the life of the cathode is short.

The poor mechanical stability and columnar structure of the deposited CVD layers, however, normally also makes the manufacture of self-supporting cathodes without a support of pyrolytic graphite impossible.

Arbitrarily curved cathode surfaces endeavoured, for example, in the form of a cylindrical unipotential cathode, can as a rule be realized only in polycrystalline material. It is known that in monophase cathodes and also in monolayer cathodes the electron work function each time depends on the type of facet on the surface. Different surface orientations result in considerably different electron emissions.

In the methods of manufacturing for example, powder metallurgy, the resulting cathodes as a rule consist of polycrystalline surfaces having statistically oriented crystallites. Consequently, only few crystallites and monolayer-coated crystallites, respectively, with correspondingly favourable orientation emit to a very considerable extent and by far the greater part of the crystallites hardly contributes to the emission.

The growth of crystallites having such an orientation which, for example, in a monolayer coating having the lowest work function, consequently leads to an immense increase of the emission current density.

Such cathodes having preferentially oriented polycrystalline surface and a method of manufacturing the same are known from the already mentioned German Offenlegungsschrift No. 14 39 890. "Preferentially oriented" means that nearly all crystallite surfaces contribute to the emission and have such a facet on the surface that the normal to said facet and the normal to the macroscopic cathode surface at this location lie within a specified angle. Some of the few possibilities to manufacture such a preferentially oriented polycrystalline surface according to the above-mentioned Offenlegungsschrift is the chemical deposition from the gaseous phase in which certain combinations of the deposition parameters, in particular of substrate temperature and flow rates of the gas mixture, have to be maintained. Generally the substrate used is a conventional cathode on which in addition a polycrystalline layer is deposited by means of the CVD method. This layer may be either a pure, high-melting-point metal, such as W, Mo, Ta, Nb, Re, Hf, Ir, Os, Pt, Rh, Ru, Th, Ti, V, Yb, Zr, or Carbon and must have a correct preferred orientation, or it may be a material of high emission, preferably an oxide of rare earth metals, ZrC, ThC, $UC_2$, UN, $LaB_6$ or $NdB_6$.

Of special preference in all embodiments is a polycrystalline tungsten coating layer on the cathode with the crystallographic <111> phase on the surface. The monoatomic emitter layer formed thereon by diffusion from the interior of the cathode or by absorption from the vapour preferably consists of Th, Ba or Cs and together with the preferential orientation produces a lower work function than that of the pure materials in question and of monolayers, respectively, on non-oriented tungsten.

However, the cathodes manufactured in this manner also have a series of disadvantages. An important disadvantage is, for example, that first of all conventional cathodes have to be manufactured according to the usual powder metallurgical methods and that they are then coated with the preferentially oriented CVD layer in which, however, a series of surface treatment steps have to be added additionally so as to obtain the preferred orientation. Hence the manufacture of such cathodes is expensive. Furthermore, the design of the cathodes is strongly restricted by the powder metallurgical manufacture of the substrates.

Although according to the German Offenlegungsschrift No. 14 39 890 thoriated wires are coated with <111> oriented tungsten from which again a mesh cathode can be manufactured, the method does not enable the manufacture of a cylindrical unipotential cathode of thoriated tungsten because the correspondingly shaped substrate cathode cannot be manufactured in a powder metallurgical method if simultaneously it has to be directly and effectively heated.

A further difficulty is that the recrystallization and the crystal growth, occurring respectively, at extended operating periods and normal operating temperatures (2000° in Th—[W]—cathodes) leads to an increasing destruction of the preferential orientation as a result of which the emission of course decreases. Unfortunately this occurs within periods much shorter than the rated value of 10,000 hours cathode lifetime necessary for UHF tubes (see I. Weissman, "Research on Thermionic Electron Emitting Systems" Varian Ass. Final Report (1966) Navy Department Bureau of Ships (SA)). In a large number of cases the preferential orientation is even destroyed already in the activating phase of the cathode. In the case of a CVD deposition of a surface layer of an oxide of rare earth metals or of ZrC, ThC, UC or UN it is a further disadvantage that the specific advantages of monolayer cathodes are not used, especially the higher emission. Instead thereof, for example, the considerably smaller dc-emission of oxide cathodes is obtained, where the semi-conducting oxide layer has the usual problems like charge carrier depletion and lower loadability. When borides are deposited the problem again occurs that the contact layer (boundary regions) to the metal support usually pulverize. The methods known from said Offenlegungsschrift do not disclose cathodes which are better suited for UHF tubes.

From German Auslegeschriften Nos. 10 29 943 and 10 37 599 dispenser cathodes having porous sintered bodies are known which are constructed layerwise in such manner that layers of high-melting metal, such as tungsten or molybdenum, and layers with emission-stimulating material, such as thorium or thorium compounds or barium aluminate, alternating with each other, the coating layer of tungsten or molybdenum below the emissive surface being formed to be slightly thicker and the support for the layer structure consisting of tungsten, molybdenum or carbon.

Important for the function of said cathodes is that they are porous and that the emissive material can easily reach the surface. The only object of the layerwise manufacture is to obtain a uniform distribution of the emissive materials in the storage area. The layers must be closely indented by means of a coarse granular structure. Such cathodes are manufactured by sintering powder layers on the carrier or also by (physical) vapour deposition of a layer on the carriers.

However, such cathodes have various striking disadvantages. First of all, the porosity leads to too strong an evaporation of the emissive material and hence to very bad vacuum properties, which makes the use thereof in UHF electron tubes doubtful. Secondly, the overall material thickness necessary for the manufacture requires too large a heating power. Third, since physical deposition as the alternative method only yields very thin layers, the manufacture generally is carried out by means of the powder metallurgical methods involving all the disadvantages of a powder-metallurgical cathode manufacture. These said advantages are in particular the restrictions in geometry caused by layerwise manufacture and press-sintering. In addition there is the poor mechanical stability of the porous structure, since in pressing arbitrary shapes of the layers must be kept out of consideration and in addition the sintering temperature must be kept so low that the emissive material does not evaporate in advance. Very many processing steps are necessary. Finally, the only object of the layer structure is to ensure a uniform distribution of the emissive material in the dispensing area which can also be achieved by other less expensive methods such as impregnation or powder mixing. Besides, by intent, the layer structure is not maintained during the life of the cathodes. Above all, these cathode are metal capillary cathodes (MK)-cathodes, not the compact dispenser cathodes which are the object of the present invention.

On the contrary, the object of the present invention is to provide a thermionic cathode which is suitable as a unipotential cathode for use in UHF and microwave tubes and which obtains the advantages of a large area cathode having a geometrical shape to be chosen freely, with a large emission current and a stable high frequency behaviour for a long period of operation.

According to the invention this object is achieved in that in a method of the kind described in the opening paragraph.

(a) the following layer structure is provided on a substrate, formed in accordance with the desired cathode geometry by transport via the gaseous phase, preferably accompanied by reducing reactions during or after deposition of the layers:
  (α) A supporting layer of a high-melting metal as a base material and at least one dopant for the mechanical structural stabilization,
  (β) a layer or a series of layers which during operation of the cathode act as supply and dispensing region consisting of a high-melting metal as a base material and a supply of electron emissive material, and
  (γ) the polycrystalline coating layer or a preferred oriented polycrystalline coating layer of a high-melting metal as a base material and at least one dopant for the stabilization of the texture and structure, the preferred orientation being adjusted by the choice of the deposition parameters in such manner that the work function from the emitter monolayer which during operation of the cathode is maintained on said coating layer, is minimum,
(b) the substrate is removed, and
(c) the supporting layer is equipped with connections for the heating.

The layers are preferably provided by reactive deposition methods such as, for example, CVD methods, pyrolysis, sputtering, vacuum condensation or plasma-sputtering.

As base materials there are preferably used W, Mo, Ta, Nb, Re and/or C, the composition of the base material in the individual layers being identical or different.

In a particularly advantageous embodiment of the method in accordance with the invention the gases taking part in the deposition reaction are activated by generating a plasma for chemical conversion and associated deposition of cathode material (so-called plasma-activated CVD method=PCVD).

In the method in accordance with the invention which may be used in particular for the manufacture of thermionic monolayer cathodes having a large electron emission density, a layer structure consisting at least of a high-melting-point metal and a material for high electron emission formed as monolayer formed is deposited successively in a continuous method, for example, by reactive deposition from the gaseous phase (CVD method) of at least two components on a substrate, the substrate being removed after the deposition so that a self-supporting CVD total cathode is obtained. Such a cathode constructed as a cylindrical unipotential cathode, is particularly suitable for transmission tubes and amplifier tubes at high frequencies and/or high powers.

The thermionic cathode manufactured in accordance with the invention the material of which is substantially a high-melting metal, for example, W, Mo, Ta, Nb and or Re and/or carbon, consists of a fine crystalline, mechanically stable, supporting or base layer, a series of layers enriched considerably with emissive material and a possibly preferentially oriented coating layer, all the layers being deposited via the gaseous phase, preferably by CVD methods, and the substratum being removed after termination of the deposition.

In the method in accordance with the invention, an extremely fine-grained supporting layer of high-melting metal having good mechanical properties and grain growth suppressed by dopings is first provided on a suitable (and suitably formed) substrate by reactive deposition from the gaseous phase (CVD method). A layer or a series of layers of alternately electron-emissive material and base material is then provided, the composition of the layers being controlled by variation of the gas flows, for example, in the CVD deposition. Finally, the coating layer is a preferably preferentially oriented columnar layer of a high-melting metal which is protected from grain growth and destruction of the preferred orientation by additions. After termination of the deposition the substrate and the substrate preform, respectively, are detached from the positive (i.e. from the layer structure) and a self-supporting cathode having the desired properties is obtained, for example, in the form of a cylindrical self-supporting directly heated unipotential cathode of high emission and long life.

The substrate consists preferably of an easily and accurately formable material which has a low degree of bonding energy to the cathode material deposited thereon. The removal of the substrate is carried out according to the invention either by selective etching, mechanically or by evaporating upon heating in a vacuum, for example in a vacuum furnace, or in a suitable gas atmosphere, for example, hydrogen, by burning off or by a combination of such methods in accordance with the material used for the substrate.

According to the invention, the substrate maybe, for example, a body of graphite, in particular of pyrolytic graphite, or glassy carbon, which is removed by mechanical processes, burning and/or mechanical-chemical micropolishing. The substrate may also consist of copper, nickel, iron, molybdenum or an alloy with a major portion of these metals and is removed by a selective etching treatment, or first for the greater part mechanically and the remaining residues by evaporation by means of heating in a vacuum (for example, in a vacuum furnace), or in a suitable gas atmosphere (for example, in hydrogen).

The substrate used for the method in accordance with the invention must be has little as compatible as possible with the layer material, that is to say with the material of which the supporting parts of the cathode are manufactured, i.e. it must be readily detachable therefrom. This requirement is advantageously fulfilled by graphite. Graphite, for example polycrystalline electrographite, can easily be worked mechanically so that bodies of complicated shapes can also easily be manufactured. However since electrographite is porous, a thin layer of pyrolytic graphite is deposited on the preforms manufactured therefrom, said layer being substantially free fo pores and forming a good substrate for the deposition of the cathode material.

For detaching the finished cathode from the substrate, various methods are possible with graphite in accordance with the design of the substrate body. The cathode can often be pulled off from the graphite body very simply and with only a small force by pulling or pressing in the direction of the layer axis (a-axis) of the pyrolytic graphite. A safe detachment is obtained by using the different coefficients of thermal expansion of the graphite substrate and of the cathode which is formed, for example, from tungsten. Since upon heating tungsten expands considerably more than graphite, the finished cathode is cleaved especially upon coating the outer surfaces of cylindrical substrate bodies by heating to, for example, 300° C. above the deposition temperature. Upon coating the inner surface of a cylindrical hollow body of graphite, preferably at 500° C., the desired cleavage is obtained in an even simpler manner by cooling to room temperature. Another simple method of removing graphite, for example in inaccessible places, is burning off. Particularly pure and uniform surfaces are obtained by micropolishing.

Substrate bodies of copper or nickel can also be readily worked and detached. Copper is first removed mechanically for the greater part, for example, by machining. Copper residues can be detached in a vacuum furnace by evaporation at 1800° C. to 1900° C. or, if nickel, by selective etching or micropolishing. As an etchant especially for nickel there is used especially a mixture of $HNO_3$, $H_2O$ and $H_2O_2$ in the mixing ratio of 6:3:1 parts by volume or an aqueous solution of 220 g of $Ce(NH_4)_2(NO_3)_6$ and 110 ml of $HNO_3$ in 1 l of $H_2O$ is used. Subtrates of copper can be detached by use of a solution of 200 g of $FeCl_3$ per 1 l of $H_2O$ at an operating temperature of 50° C. Substrates of molybdenum are preferably etched away by dipping in a boiling solution of equal parts by volume of $HNO_3$, HCl and $H_2O$.

A thermionic cathode manufactured by means of the method in accordance with the invention is self-supporting and is formed in a flat plane and has a thickness of 50 μm to 500 μm, preferably 100 to 150 μm, while larger thicknesses can also be realized without any problems.

In order to be able to manufacture thin and self-supporting forms from high-melting-point brittle metal by reactive deposition from the gaseous phase, a modification of the CVD method is desired. In fact, in the usual deposition, columnar structures of low mechanical and thermal stability and a tendency to strong crystallite growth under operating conditions are obtained. Therefore, for the manufacture of the supporting layer, i.e. the supporting cathode base, modified CVD methods are preferably used which produce extremely fine-grained structures having larger thermomechanical load-abilities. This may be obtained in three manners:

A simple but a bit time-consuming possibility is presented by repeated interruption of the CVD layer growth by repeated substrate cooling to room temperature and restart of the nucleation by heating again, or a periodic variation of the substrate temperature in the range between 300° and 700° C. is carried out. A succession of different layers is obtained, for example, of tungsten, the properties of which are already significantly improved as compared with the continuously deposited material. In a few cases, for example, in direct resistance heating of the substrate in a "cold wall" coating, it is also possible to vary the composition of the reaction mixture periodically, especially the part of that reaction partner which produces the greater cooling of the substrate. In the case of the production of the tungsten CVD from $WF_6+H_2$ it is, for example, the hydrogen gas flow which is modulated.

The second possiblity for the stabilization of the structure is the deposition of extremely thin crystallite growth-inhibiting intermediate layers. Tungsten again serves as an example, the deposition of which from the gaseous phase is periodically interrupted by pinching the $WF_6+H_2$ gas flow. Instead of this, alternately a carrier gas with f.e. a metal organic thorium compound from a saturator is introduced so that f.e. a $ThO_2$ intermediate layer is deposited.

Instead of this a similar effect is obtained in the intermediate layer by deposition of carbon at very high saturator temperatures. The thickness of the tungsten layer is in the order of magnitude of 1 μm, that of the thorium- and carbon-containing intermediate layers, respectively, is significantly lower (about 0.2 μm).

The third method is based on the fact that the base material is deposited together with a dopant material which has a negligible solid solubility in the crystal lattice of the layer material. For example, for the manufacture of the layers, tungsten with 2% $ThO_2$ is deposited. In such a deposition from the gaseous phase (multicomponent-CVD-method) an extremely fine and uniform distribution of the admixture in the later material is formed. As a result of this, on one hand the ultimate tensile strength of the layer material is increased considerably, in the example of the tungsten doped with 2% $ThO_2$ it is approximately doubled, on the other hand the said admixture inhibits the crystal growth in the layer material at operating temperatures and as a result produces a stabilization of the crystal structure, especially of the grain size, which is preferably adjusted at values of approximately 1 μm and lower, and of the preferred orientation of the crystals over longer periods of cathode operation. (As a result of the said admixtures the cathodes according to the invention obtain a life of $10^4$ hours at usual up rating temperatures and at increased emission levels).

Since the supporting base layer of high-melting metal is deposited in a fine crystalline and grain stabilized manner due to foreign dopings, the mechanical loadability becomes approximately three times as large as that of the pure CVD material. Since the dopings which are substantially not soluble in the base material are deposited either simultaneously in a finely dispersed or alternatingly in a high frequency series of layers per CVD, an excessive seed growth is interrupted again and again. In particular, due to these dopings with alien material, the grain growth under normal operating temperatures is considerably inhibited so that the mechanical stability is ensured also during a longer life.

Besides an admixture of $ThO_2$ in tungsten in the above, the stabilization of for example W- as a base material can also be obtained by other substances at least in so far as they have a small or negligible solid solubility in tungsten (for example scandium, yttrium) and the melting point thereof is above 2000 K. These substances include especially Zr, $ZrO_2$, Ru, $UO_2$, $Sc_2O_3$ and $Y_2O_3$ which moreover can be deposited advantageously from the gaseous phase simultaneously with the layer material.

The same applies in principle also to other high-melting base materials in which accordingly a material component which is not soluble therein has to be deposited alternatingly or simultaneously in fine admixture.

A structure stabilization of the supporting layer, can only be produced by correspondingly small admixtures which in general don't have to be identical with the emitting material. In order to extend cathode life time and increase the emission, extra layers with considerably larger doping concentration of emissive material are necessary.

Therefore a storage and dispenser layer, of large doping concentration of emissive material is provided on the structure-stabilized base. This dispenser region advantageously consists of a high frequency series of layers, in which layers of emissive material alternate with layers of base material in such manner that said layers are still sufficiently mechanically stable and readily bonded to the CVD carrier layer and at the same time have a large average emitter concentration in the dispenser zone/region of preferably 10 to 20% by weight.

Such a series of layers according to the invention is manufactured by reactive deposition from the gaseous phase with a variation in time of the parameters, especially of the flow rates of the gases taking part in the reaction and/or of the substrate temperature.

The temporal variation of the CVD parameters occurs preferably periodically, especially alternatingly between the optimum patameters for depositing the emissive material and those for CVD of the base material. Usually, a corresponding variation each time of the gas flow quantities is sufficient; in a few cases, however, the substrate temperature must also be increased or decreased in the correct manner.

The electron emissive material is preferably selected from the scandium group (Sc, Y, La, Ac, lanthanides, actinides) and deposited in the form of metal, oxide or boride and or carbide together with the base material, preferably W, Mo, Nb, Ta, Re from the gaseous phase. According to the invention in particular the following material combinations serve as emissive material+base material: $Th/ThO_2+W$, $Th/ThO_2+Nb$, $ThB_4+Re$, $Y/Y_2O_3+Ta$, or as emissive materials are deposited $Sc_2O_3$, $Y_2O_3$ or $La_2O_3$ in combination with molybdenum or tungsten as base material. Favourable combinations are also oxides of Ce, Sm and Eu with tungsten or molybdenum. $ThB_4$ is preferably provided by pyrolysis of $Th(BH_4)_4$, where for example argon is used as carrier gas, on a layer of rhenium with an underlying structure-stabilized tungsten support, at substrate temperature exceeding or equal to 300° C.

When the emissive material is deposited in oxide form a further improvement of cathode properties can be obtained when an activator component, preferably boron or carbon, for liberating the emitter in an atomic form, and in addition a diffusion-intensifying component are also deposited by CVD method. As constituents promoting or intensifying diffusion for the emissive material are preferably used Pt, Os, Ru, Rh Re, Ir or Pd in concentrations of 0.1 to 1% by weight.

In the manufacture of the cathodes according to the invention substrate temperatures of 200° to 600° C. (so-called low temperatures CVD methods) are preferably used. Especially the following volatile starting compounds are used for depositing Mo, W, Re, Pt metals, rare earth metals, thorium and actinides:

1. Metal halides, preferably fluorides, with $H_2$ as a reduction agent. Deposition of the metals Mo, W, Re at temperatures from 400° to 1400° C., preferably from 500° to 800° C., especially from 500° to 600° C.
2. Metal carbonyls $M(CO)_n$; A part of the CO groups can be replaced by H, halogens, NO, $PF_3$. Deposition of Mo, W, Re and Pt metals at temperatures from 300° to 600° C.
3. Metal trifluorophosphanes $M(PF_3)_n$: Fluorine can be replaced entirely or partly by H, Cl, Br, I, alkyls and aryls, the $PF_3$ groups by CO, H, Cl, Br, J, CO, NO. Physically and chemically this group resembles the metal carbonyls. The deposition of Mo, W, Re and Pt metals is possible at temperatures from 200° to 600° C.
4. Metalocenes $M(C_5H_5)_n$: They belong to the group of the metal organic sandwich compounds. The $(C_5H_5)$ groups may be replaced partly by H, halogens, CO, NO, $PF_3$ and $PR_3$. Mo, W, Pt metals may be deposited by pyrolysis. With $H_2$ as reaction components the reaction temperature is considerably reduced.
5. Metal-$\beta$-diketonates; Acetyl acetonates $M(aa)_n$ and the 1,1,1-trifluoroacetylacetonates $M(tfa)_n$ and 1,1,1,5,5,5-hexafluoroacetylacetonates $M(hfa)_n$; from these compounds may be deposited metals of the platinum group and oxides of the lanthanides including $Sc_2O_3$ and $Y_2O_3$ and oxides of the actinides including $ThO_2$. The deposition temperatures are from 400° to 600° C. for the acetylacetonates and 250° C. for the fluorinated acetylacetonates.
6. Metal alcoholates $M(OR)_n$: The deposition of the oxides of the lanthanides and actinides including $Sc_2O_3$; $Y_2O_3$ and $ThO_2$ is possible at temperatures from 400° to 600° C. Double oxides may also be deposited in some cases, for example, $MgAl_2O_4$.

Tungsten and thorium and $ThO_2$, respectively, are preferably grown alternately or simultaneously from $WF_6+H_2$ and Th-diketonate, especially Th-acetylacetonate, preferably Th-trifluoroacetylacetonate or Th-hexafluoroacetylacetonate, but also Th-heptafluorodimethyl-octanedione or Th-dipivaloylmethane, by reactive deposition from the gaseous phase at temperatures between 400° and 650° C., the metal organic Th starting compound being present in powder form in a saturating device which is heated to a temperature just below the relevant melting point and through which an inert gas flows as a carrier gas, in particular argon.

As a rule the layer structure of the dispensing region is constructed so that the layer thicknesses of the base material layers are approximately 1 to 10 $\mu$m and those of the emissive material are approximately 0.1 to 1 $\mu$m. In a preferred embodiment of the method in accordance with the invention the dispensing region with emissive material in the form of a series of layers is provided by means of a CVD method on a structure-stabilized doped CVD carrier layer having a thickness from 30 to 300 $\mu$m, in particular a 100 $\mu$m thickness, each time a layer of high-melting metal with small admixtures of electron emissive material and possibly stabilizing doping being alternated by such a layer having high concentrations of electron emissive material, which layer is slightly thinner, the layer distances being in the order of the grain sizes. In particular, the individual layer thickness is 0.5 to 10 $\mu$m with a concentration of the emissive material up to 5% by weight and is 0.1 to 2 $\mu$m with a concentration of the emissive material from 5 to 50% by weight. The average concentration of emissive material is preferably 15 to 20% by weight.

A preferentially oriented coating layer is then provided on the supply zone which ensures an increased emission. Said coating layer may consist of the same material as the base or of a different material which is chosen to be so that the work function for the combination emitter monolayer-coating layer becomes still lower than that of the emitter-base combination. As a rule the coating layer consists of a metal having a large work function which reduces the work function correspondingly via a high dipole moment between emitter film and coating layer. Said dipole moment on the electro-positive emitter film not only depends on the material but also on the crystallite surface orientation thereof. A means to further intensify said substractive dipole field and thereby to increase the emission is to provide a suitably oriented polycrystalline surface layer instead of a non-textured surface. Said preferred orientation can be obtained substantially only by deposition from the gaseous phase optionally on well pretreated surfaces. In the case of a thorium monolayer on tungsten, <111> is the correct preferential orientation for tungsten. The provided surface layer, however, must still satisfy further conditions. An important extra requirement is that it must be very fine-crystalline. This is caused as follows:

Because most of the conventional emissive materials only have small solubilities in the high-melting materials of which the supporting base frame of the cathode (base) with the coating layer consists, the diffusion of the emissive material from the interior to the cathode surface takes place along the grain boundaries. So in order to ensure a sufficient dispensing to the surface for compensating the losses of emissive materials resulting from evaporation, and ensure a sufficient surface coating by said dispensing, the number of grain boundaries per surface area may not be too small and the diffusion paths along the surface may not be too long.

In general this requirement is fulfilled by conventional cathodes at moderately high operating temperatures. At higher temperatures which normally also involve a larger emission, however, the desorption of the emissive material increases considerably as compared with the surface diffusion so that a sufficient monolayer coating is no longer ensured. The resulting decrease of the emission is critically dependent on the average grain diameters and occurs at temperatures the higher the smaller the average grain size is. For Th-[W] cathodes an average tungsten grain diameter of $\leqq 1$ $\mu$m means an increase of the useful temperature range up to $\geqq 2400$ K.

Such small stable grain sizes can be manufactured (for stable operation) substantially only by CVD methods and here only by the correct choice of the parameters. Said surface structure must of course also satisfy the further requirement of remaining stable with respect to longer thermal loads. For example, when during operation of the cathode the grain size becomes too large due to recrystallization, this finally produces a decrease of the emission current and hence a shorter life due to the deterioration of the mono-atomic coating. The same stability requirement also applies to the texture, i.e. the adjusted preferantial orientation on the surface must be maintained.

Said recrystallization is prevented analogously to the mechanical stabilization of the supporting layer by the addition of a substance which is not soluble in the crystal lattice of the coating layer material which is simultaneously deposited also from the gaseous phase. In the case of tungsten as a coating layer or base material, dopings with Th, $ThO_2$, Zr, $ZrO_2$, $UO_2$, Y, Sc, $Y_2O_3$, $Sc_2O_3$ and Ru are suitable due to their low solid solubility in W. Assuming an operating temperature of 2000 K. (i.e. the melting point of the doping must be higher) and requiring a simple handling, $ThO_2$, $ZrO_2$, $Y_2O_3$, $Sc_2O_3$ and Ru remain as preferred CVD dopings. In particular the doping may also be identical to the emitting material if Th, Y or Sc form the emitter monolayer.

Preventing the crystallite growth means simultaneously a stabilization of the structure which without doping is destroyed already in the activating phase of the cathode in the major number of cases. The destruction of the texture at higher operating temperatures for pure materials may be caused by considerable growth of minority crystallites at the expense of the preferentially oriented majority, or because crystallite growth starts from the non-oriented base.

Herewith, cathodes with preferentially oriented coating layer, which simultaneously means a higher emission than from conventional cathodes, can be manufactured which also have a correspondingly long life.

The different parts (layers) of such a cathode totally manufactured by CVD according to the invention must hence fulfil different tasks and consequently must be structured in accordance with these requirements. In many cases it is recommended first to provide additionally an easily removable separate intermediate layer on the substratum. The subsequent doped base layer which is very fine grained serves for the mechanical stabilization of the cathode structure also under thermal loads and makes it possible to manufacture self-supporting substrateless CVD-structures. In the dispensing part finally it is in particular a large store of emissive material that matters. The mechanical properties and the grain structure in this area are less critical as long as a high doping concentration of emissive material is realized, advantageously approximately 10 to 30% by weight.

The preferentially oriented coating layer on the contrary ensures a very low electron work function from the surface dipole layer and in addition a good coating with the monoatomic emitter film by means of the fine crystalline structure thereof. Moreover it is texture-stabilized due to low (minute) insoluble dopings.

In addition to the coating of the outer surface of a substrate body, an inner coating of a suitable hollow body may also be carried out. However, the layers are then provided in inverted sequence, i.e. first the preferentially oriented coating layer is deposited, the dispensing zone is then provided and finally the mechanically stable supporting base. The finished cathode body is finally provided with connections for the direct heating-current.

The advantages of the invention are that thermionic cathodes having a large area and high emission currents, a stable high frequency behaviour and also a geometrical shape which may be chosen freely become available which have a long life, all this apt for big series automated production at low manufacturing cost without time-consuming manual processing steps as for mesh cathodes. By using the CVD method the machining of the known high-melting and very hard cathode materials, for example tungsten, which is expensive and difficult, is avoided and simultaneously a substantially arbitrary layer structure can be manufactured.

Particularly advantageous is the manufacture of the total cathode with all material layers by reactive deposition in one continuous process.

In a further embodiment of the invention the layer structure is provided so that the above-mentioned three layers $\alpha$, $\beta$ and $\gamma$ are identical. Herewith it is achieved that one single layer takes over the functions of the layers $\alpha$, $\beta$ and $\gamma$. This single layer has a suitable texture and a high emitter and doping concentration, respectively; simultaneously it is texture-stabilized, microstructure-stabilized and mechanically stable under thermal loads due to finely dispersed dopings.

The cathodes manufactured according to the invention distinguish by the combination of a long life, high emitter concentration and high mechanical stability.

Figure 2:
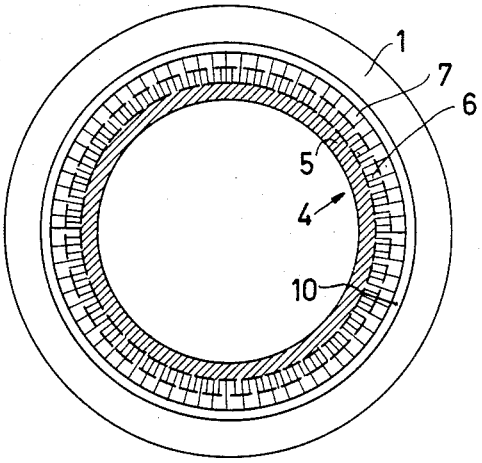
Figure 3A:
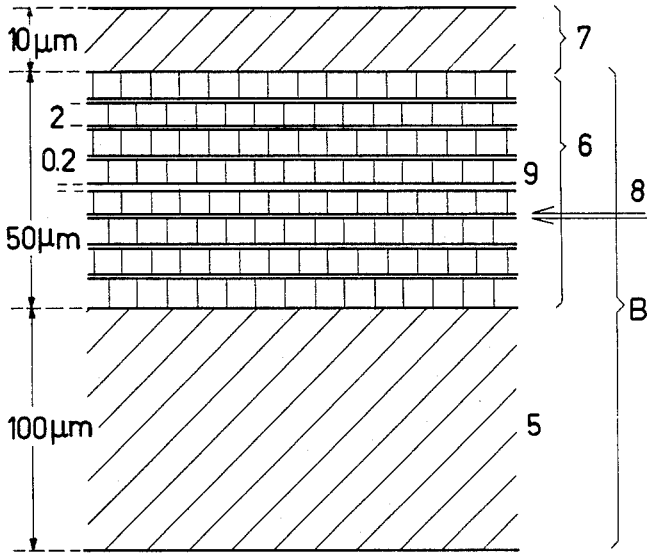
Figure 3B:
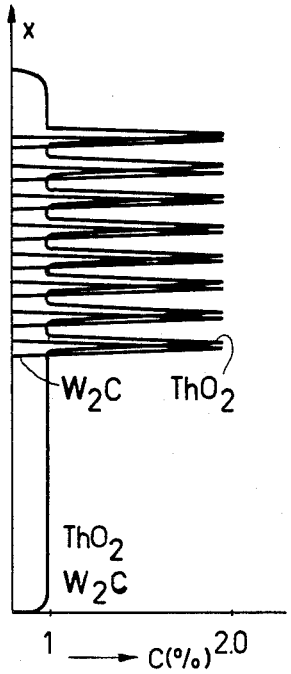
Figure 4:
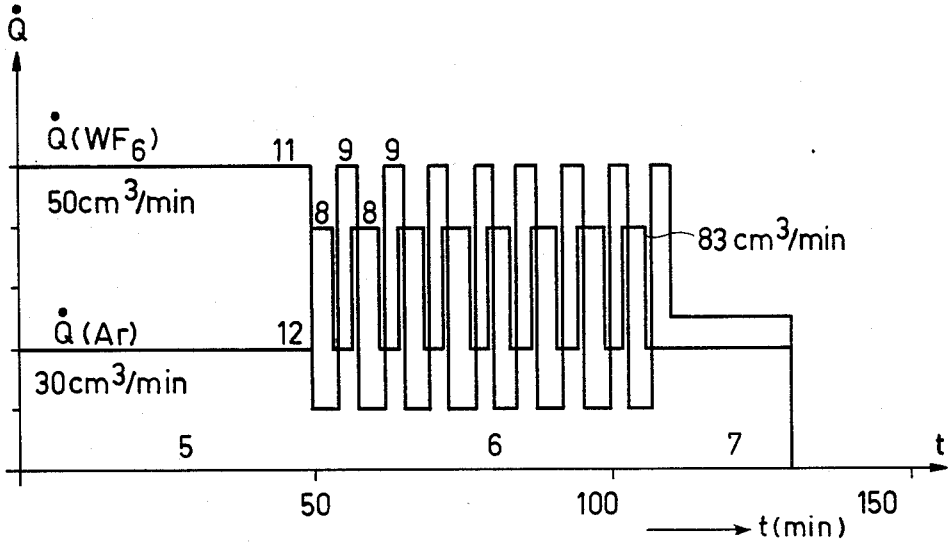
Figure 5:
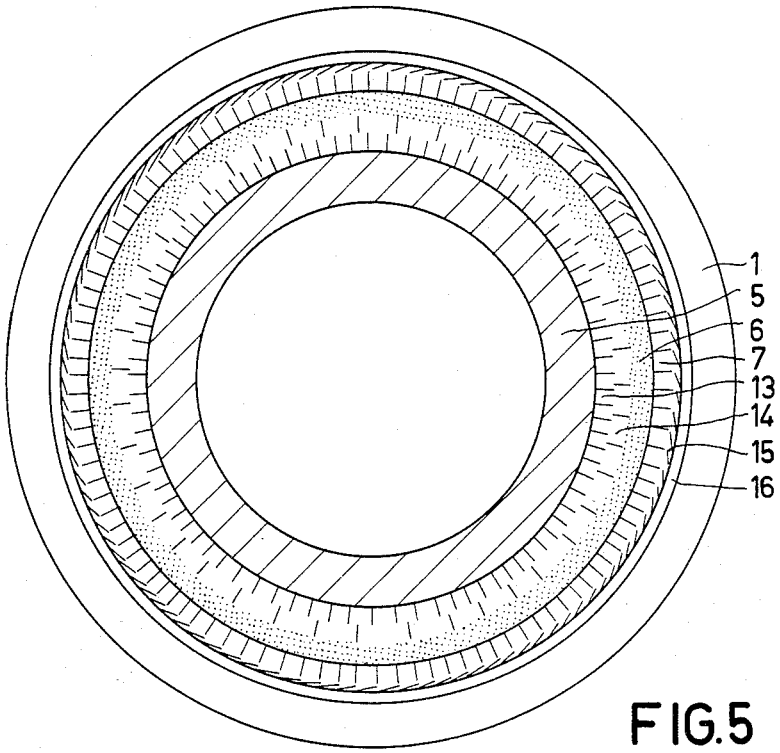
Figure 6:
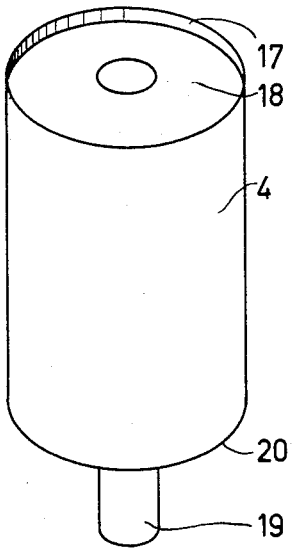
Figure 7:
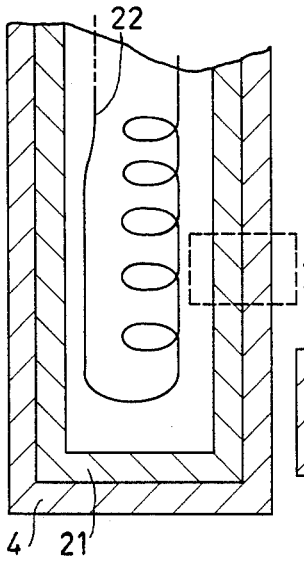
Figure 8:
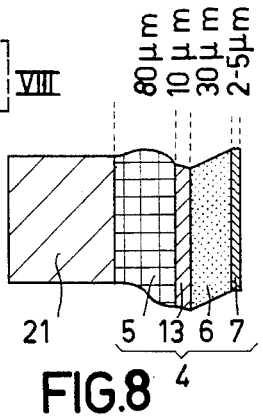

The invention will now be described in greater detail, by way of example, with reference to the accompanying drawing, in which FIG. 1 is a sectional view taken on the longitudinal axis through a deposition device for a cathode, FIG. 2 is a sectional view of the device shown in FIG. 1 with a cathode manufactured according to example 1 perpendicular to the longitudinal axis, FIG. 3*a* is a cross-sectional view through a Th+W-CVD cathode according to example 2, FIG. 3*b* shows the associated $(W_2C)ThO_2$ concentration profile, FIG. 4 shows the variation in time of $WF_6$- and Ar-gas flow rates to obtain the cathode structure shown in FIG. 3*a*, FIG. 5 is a sectional view of the device shown in FIG. 1 with a cathode manufactured according to example 3 perpendicularly to the longitudinal axis, FIG. 6 shows a finished cathode according to example 3 provided with an inner conductor and a ring contact for direct heating, FIG. 7 shows a sectional view parallel to the longitudinal axis through a cathode substrate according to example 4 coated on the outside, and FIG. 8 shows on an enlarged scale a particular area of FIG. 7.

EXAMPLE 1

The device shown in FIG. 1 is mounted in the interior of a reactive deposition chamber suited for deposition of substances from the gaseous phase (CVD-reactor) which is known in principle and which consists of a gas supply system with the respective mass flow controllers, the reaction chamber and the exhaust system. A hollow cylinder 1 of pyrolytic graphite which serves as a substrate, has an inside diameter of 12 mm, a length of 95 mm and a wall thickness of approximately 200 $\mu$m, is surrounded over its full length by a heating coil 3 of tungsten wire and is held at the ends thereof in cover plates 2 also made of pyrolytic material. The pyrolytic graphite of the substrate 1 is laminated parallel to the inner surface, i.e. the crystallographic c-axis lies in the direction of the normal to the plane of the cylinder surface. The heating of the graphite cylinder, however, may also be carried out by direct passage of current through the cylinder.

In the CVD method the cathode 4 is formed by growth on the inner cylinder surface of the substrate 1 in an inverted sequence of the layers of the cathode, i.e. the final surface layer of the cathode is deposited first and the final interior support layer of the cathode is deposited last.

In the above example the substrate 1 is heated to a temperature of 550° to 600° C., the reaction gases are supplied at a pressure of approximately 50 mbar.

FIG. 2 shows the grown layers of the cathode in a sectional view transverse to the longitudinal axis of the hollow substrate cylinder 1. First, a finely crystalline (grain sizes 1 μm and smaller) W layer 7 which has a preferred orientation in <1,1,1> direction with respect to the substrate surface, is doped with 1% $ThO_2$ for stabilization of the crystal frame, and has a thickness of 5 μm, is deposited on the substrate. For that purpose $WF_6$ with a flow rate of 30 to 50 $cm^3$ per minute, $H_2$ with a flow rate of 400 to 500 $cm^3$ per minute and thorium-acetylacetonate-saturated Ar with a flow rate of 100 $cm^3$ per minute are passed over the substrate as a mixture for approximately 3 to 5 minutes. The hydrogen serves as a reducing gas for the metal compounds. The thorium-acetylacetonate is in powder form in a saturation vessel which is kept at a temperature of 160° C. and through which Ar is passed serving as carrier gas. The reaction gases are mixed in a mixing chamber, which is heated at a temperature of approximately 180° C., and are passed through a nozzle to the substrate-surface.

The temperature of the saturation device of 160° C. must be maintained accurately because below −150° C. the $Th(AcAc)_4$ vapour pressure is too small for a coating and at −170° C. a premature decomposition of said compound occurs already in the saturator. After the growth of the preferentially oriented outer layer of the cathode the dispensing layer 6 enriched with electron-emissive material is deposited. For that purpose, at flow rates of approximately 15 $cm^3$ per minute for $WF_6$ and 150 $cm^3$ per minute for the $H_2$, respectively, a flow rate for argon of approximately 85 $cm^3$ per minute is employed. As a result, a W layer with an admixture of approximately 20% $ThO_2$ is formed, eventually by means of an extra oxidizing gas such as $CO_2$. After a deposition period of approximately 100 minutes the layer reaches a thickness of approximately 40 μm. Carburization as in conventional thoriated tungsten cathodes is not necessary any longer because carbon is sufficiently deposited from $ThC_{20}H_{28}O_8$. An approach likewise used for deposition of the dispensing part is the alternate growth of $Th(ThO_2)$- and W layers, in which especially the $WF_6$ flow rate varies between 10 and 60 $cm^3$ per minute and the Ar flow rate varies between 85 and 30 $cm^3$ per minute. As a rule the $H_2$ rate is the tenfold of the $WF_6$ rate and the intervals are 1 minute for W layers and approximately 5 minutes for Th layers which have thicknesses of approximately 4 μm and 1 μm, respectively. The supporting cathode part 5 is then manufactured in a layer thickness of approximately 50 to 100 μm. For that purpose either again the initial flow rates are adjusted, this time at a temperature of 500° C., or the parameters of the layer sequence of the dispensing zone are switched at a high rate, in which the duration of the W intervals is 20 sec. each time and of the Th intervals is approximately 1 minute. As top layer may then be deposited additionally a pure W layer of approximately 10 μm.

For the rapid switching between various parameter sets a computer control of the gas flow controllers is generally used.

Especially for obtaining layers of uniform thickness within the graphite tube, a high-frequency modulation of all flow rates is advisable.

After these deposition processes, substrate and cathode are slowly cooled to room temperature. Caused by the different coefficients of thermal expansion of the two materials and due to the poor bonding of the tungsten to pyrolytic graphite, the thoriated tungsten cathode 4 upon cooling by more than 500° C. shrinks in diameter by approximately 10 μm more than the hollow cylinder 1 and separates therefrom. Due to the formed gap 10 the tungsten thorium cathode is drawn out of the substrate cylinder without any difficulty. Because the inner cylinder surface of the substrate consists of pyrolytic graphite having a very smooth uniform surface, the outer surface of the finished cathode without after-polishing has a high surface quality which is not influenced either by irregularities in the deposited layers.

The finished tubular cathode body is cut into various short pieces of tubes at right angles to the longitudinal axis thereof, for example by means of a laser beam. Each of the pieces then forms the cathode of a tube.

EXAMPLE 2

FIG. 3*a* is a cross-sectional view of the layer structure of a planar (plane) cathode which, however, may also be identical to a detail of the cylinder surface of a cylindrical cathode. The upper layer 7 is a <111> preferentially oriented polycrystalline W layer having average grain sizes from approximately 1 to 2 μm. It has a thickness of approximately 10 μm and is doped with approximately 1% finely dispersed $ThO_2$. Therebelow is the approximately 50 μm thick dispenser zone 6 which consists of individual layers 9 of 2 μm 1% thoriated W with intermediate layers 8 of 0.2 μm with approximately 20 to 40% (atomic) $ThO_2$ and a carbon enhancement in the same order of magnitude. The high sequence layer structure serves for the stabilization of the grain structure and for preserving grain sizes from 1 to 2 μm.

The dispensing region 6 together with the supporting part 5 forms the base B. With the exception of the said intermediate layers it consists generally of W with 1% $ThO_2$. Instead of 1% $ThO_2$, however, 1% $ZrO_2$ or 1% $Sc_2O_3$ is also used for the mechanical and structural stabilization toward thermal loads. All layers 5 to 9 are prepared on a substrate of Mo or graphite by deposition from the gaseous phase. The substrate is removed again after coating. FIG. 3*b* shows as a completion to FIG. 3*a* again the $ThO_2$- and C concentration profiles over the cathode cross-section. FIG. 4 shows the variation in time of the $WF_6$- and Ar flow rates $\phi_1$ 11 and 12, respectively, which variation is necessary to obtain the above cathode structure, as a function of time after the beginning of the CVD deposition. Ar is the carrier gas for thoriumacetylacetonate $Th(C_5H_7O_2)_4$, with which it is saturated after passage through the saturating device which is heated to a temperature of 160° C. The other gases flowing through the reactor are $H_2$, the flow rate of which is approximately 10 times as high as that of the $WF_6$, and $N_2$, used as flashing gas for the observation window. The substrate temperature is measured via a radiation pyrometer through the viewing window and is maintained constant at a value of approximately 500° C. The average pressure in the reactor is in the range from 10 to 100 mbar, preferably 40 mbar. The reactor itself has a temperature of approximately 180° C. Even better suited for the Th-CVD than $Th(C_5H_7O_2)_4$ is fluorinated thoriumacetylacetonate. Other special metallorganic compounds of larger vapour pressure, for example, Th-dipivaloylmethane or Th-heptafluorodimethyloctanedione are also suitable. $ThO_2$ as an emitter material can be replaced without great changes by rare earth metals, preferably by $CeO_2$, $Sm_2O_3$, $Eu_2O_3mY_2O_3$, while as a doping of W for the mechanothermal stabilization $ThO_2$ or $ZrO_2$ of $Sc_2O_3$ may be used again.

EXAMPLE 3

In the apparatus described in example 1, at first an approximately 2 μm thick layer 15 of pure tungsten is deposited within 1 minute on the substratum 1, as shown in FIG. 5, at 500° C. and cold reactor (flow rate Q(Ar)=0), all other process parameters corresponding to those for the layer 5 of example 1, FIG. 2. The $WF_6$ flow is then terminated and the substrate temperature is adjusted at 800° C. A gas mixture of $ReF_6$ with a flow rate of approximately 60 $cm^3$ per minute and $H_2$ with a flow rate of 600 $cm^3$ per minute are passed over the substrate and Re layer 7 of 5 μm thickness is deposited thereon by means of the reaction $$ReF_6+3H_2 \rightarrow Re+6HF$$

within 3 minutes which in the case it will lateron remain, is usually deposited with preferential orientation. The Re deposition is terminated by slowly decreasing the gas flows of $ReF_6$ and $H_2$ until after 2 minutes the supply of said gas is completely cut off. Simultaneously with said decrease of the gas supply the substrate temperature is adjusted at 400° C. and $Th(BH_4)_4$ is transported by use of Ar as a carrier gas to the substrate the Ar flow rate being approximately 90 $cm^3$ per minute. $Th(BH_4)_4$ is contained in powder form in a saturating device, heated to approximately 190° C. The reactor temperature during the deposition must be 200° to 210° C. By pyrolytic decomposition a layer 6 of $ThB_4$ of 30 μm thickness is deposited on the Re layer 7 within approximately 40 minutes. Thereafter with a continuous variation of the substrate temperature from 400° to 800° C. and flow rates of 60 $cm^3$ per minute for $ReF_6$, 90 $cm^3$ per minute for the $Th(BH_4)_4$ carrier gas Ar and 90 to 600 $cm^3$ per minute for $H_2$, a transition layer 14 of Re and $ThB_4$ can grow thereon to a thickness of 5 μm during 5 to 10 minutes. The supply of $TH(BH_4)_4$-carrier gas is then terminated and a 10 μm thick layer 13 of Re is deposited within 6 minutes with the process parameters mentioned for layer 7. For completion a 100 μm thick layer 5 of tungsten doped with 1% $ThO_2$ is formed which while using the process parameters mentioned in example 1 for the layer 5 is deposited in a period of time of 25 minutes at a substrate temperature of 600° C. Said layer 5 constitutes the supporting layer of the cathode.

After finishing the coatings, substrate and cathode are slowly cooled to room temperature, the total cathode shrinking loose from the substrate 1, and gap 16 is formed as described in example 1.

FIG. 6 shows a finished cathode according to this example. The cylindrical cathode body 4 manufactured in the CVD device is cut into several pieces by means of a laser beam at right angles to the longitudinal axis. On the edge 17 of one of said pieces 4 a circular disk 18 of the same diameter of tungsten or molybdenum is attached by spot welding. Said circular disk comprises in its centre a pin 19 likewise formed from tungsten or molybdenum and serving for the supply of the filament current and aligned so that the longitudinal axis thereof coincides with the cylinder axis. Over the edge 20 (contact area) of the cylinder surface 4 remote from the disk 18 the filament current is again drained. Finally the cathode is etched in a solution of 0.1 l $H_2O$+10 g potassium ferricyanide+10 g potassium hydroxide for approximately 30 seconds as a result of which the outermost layer 15 of tungsten is removed. The (preferentially oriented) Re layer 7 is also removed, if so desired. During operation of the cathode a substantially monoatomic electron emitting layer of Th is formed on the surface of the exposed $ThB_4$ layer (or on the Re layer, respectively) by diffusion of Th.

EXAMPLE 4

A further example of the method according to the invention will be described with reference to FIGS. 7 and 8. The substrate is formed by a hollow cylinder 21 of nickel, which is closed towards the direction of flow and which via a central current supply pin and a current drain is heated via the cylinder surface or is heated electrically indirectly via a W coil 22. The cylindrical cathode body 4 is deposited on the outer surface thereof. As first layer 5 tungsten which is doped with 1% $ThO_2$ and is manufactured according to the same method as the inner layer 5 of example 1, is deposited on the substrate, an 80 μm thick layer being formed at 600° C. within 20 minutes. Now $ReF_6$ starts to be supplied simultaneously, the flow rate of which is increased to the same extent as the flow rate of the $WF_6$ is reduced until after the 2 minutes only $ReF_6$ is supplied in the same quantity as previously $WF_6$, the substrate temperature being simultaneously increased from 600° to 800° C. and the supply of Ar carrier gas saturated with $Th(C_5H_7O_2)_4$ being discontinued.

In a period of time of 6 minutes a layer of pure Re of 10 μm thickness is grown with the last parameter setting. The substrate temperature is then reduced to 400° C. within 2 minutes, simultaneously the supply of $ReF_6$ and $H_2$ is slowly reduced to 0 and in the same period the supply of Ar carrier gas saturated with $Th(BH_4)_4$ is increased from the value 0 to the flow rate of 90 $cm^3$ per minute, as a result of which the deposition of $ThB_4$ is started. The supply of Ar saturated with $Th(BH_4)_4$ is continued for 40 minutes and therewith a 30 μm thick layer 6 of $ThB_4$ is grown. As termination of the series of layers, the deposition of pure Re is again started with a variation exactly reversed in time from that for the manufacture of the junction between the Re layer 13 and the $ThB_4$ layer 6 described, and a layer 7 of Re 5 μm thick is deposited on the $ThB_4$ layer 6 in 3 minutes. The substrate 21 is then detached from the cathode 4 in the manner described by selective etching, the last deposited Re layer 7 protecting the $ThB_4$ layer 6 from attack by the etching solution. As an etchant especially for nickel a mixture of $HNO_3$, $H_2O$ and $H_2O_2$ in the mixing ratio of 6:3:1 parts by volume or an aqueous solution of 220 g of $Ce(NH_4)_2(NO_3)_6$ and 110 ml of $HNO_3$ in 1 l of $H_2O$ is used. Contacting the cathode body and optionally removing the Re layer 7 is then carried out as described in example 2. In the case of direct heating of the cathode substrate via a central conductor 19 and a drain 20, only Ni is etched away beneath the cathode body, which can be insured, for example, by use of Mo supply pin and a Mo cover plate which is not attacked during the etching treatment. The right preferential orientation being given by intent, the Re layer in general remains on the cathode surface.

EXAMPLE 5

In this example the arrangement is the same as in example 1. The only important change is, that layer 7 is extended over the whole cathode body. The substrate 1 is heated to a temperature of 650° C. and the total pressure in the reaction chamber is 50 Torr. A fine-grained W-layer with a preferential orientation in the <1,1,1,> direction with respect to the substrate surface, doped with 2% $ThO_2$ by weight for microstructure stabilization, is deposited on the inner side of the PyC-cylinder by reactive deposition from the gas phase until it reaches a thickness of 150 μm. The corresponding flow rates for the supplied gases are 20 $cm^3$/min. for $WF_6$, 150 $cm^3$/min. for $H_2$, 100 $cm^3$/min. of Ar-saturated with Th-Dicatonate f.e. $Th(fod)_4$, the saturator being kept at a temperature just below the melting point of the metallorganic Th-Compound. In this example $ThO_2$ as dopant serves as emissive material and at the same time ensures microstructural and mechanical stabilization of the cathode.

Thus the invention provides a cathode: which comprises the rather singular advantages of existing cathode types, the succession of layers of which is manufactured entirely via the gaseous phase in one operation with a variation of the parameters, which is formed so as to be self-supporting having a continuous and large surface without any holes by intent as in mesh cathodes and is hence suitable as a unipotential cathode, and in which, by detaching from the substrate after the deposition, the usually detrimental interaction with the substrate is avoided. The self-supporting construction is enabled in particular by simultaneously deposited structure-stabilizing (non-soluble) additions, which additions in similar form also produce a texture stabilization of the preferentially oriented coating layer and present the advantage of the high electron emission with correctly adjusted preferred orientation also for extended times of operation.

In particular the high doping concentration with emissive material in the dispensing and storage regions contributes to the high emission and the long life, which so far could not be realised with powder metallurgical methods for arbitrary substrate forms; besides the crystalline structure of the coating layer, which is as fine as possible, with average grain diameters smaller than or equal to 1 μm, provides a good dispensing of the emissive material by grain boundary diffusion to the surface, ensures a good monoatomic surface coating also at higher temperatures and ensures low desorption rates.

What is claimed is:

1. A method of manufacturing a thermionic cathode having a polycrystalline coating layer of a high-melting metal which is deposited on underlying layers, characterized in that (a) the following layer structure is provided on a substrate, formed in accordance with a desired cathode geometry, by gaseous phase transport, preferably accompanied by reducing reactions during or after deposition of the layers;

(α) A supporting layer of high-melting metal as a base material including at least one dopant for the mechanical structural stabilization thereof (β) a layer or a series of layers which during operation of the cathode act as a dispensing and supply region for formation of an emitter monolayer, consisting of a high-melting metal as a base material and a store of electron-emissive material, and (γ) a polycrystalline coating layer particularly a preferred oriented polycrystalline coating layer of a high melting metal as a base material and at least one dopant for the stabilization of the crystal texture and structure thereof, the preferred orientation being adjusted by the choice of the deposition parameters in such manner, that the work function from the emitter monolayer which during operation of the cathode is maintained on said coating layer, is minimum, (b) the substrate is removed, and (c) the supporting layer is provided with connections for its heating.

2. A method as claimed in claim 1, characterized in that the layers are provided by reactive deposition, for example, CVD methods, pyrolysis, sputtering, vacuum condensation or plasma sputtering.

3. A method as claimed in claim 1, characterized in that W, Mo, Ta, Nb, Re and/or C is used as a base material, the composition of the base material in the individual layers being identical or different.

4. A method as claimed in claim 1 characterized in that the gases taking part in the deposition reaction are activated by generating a plasma for chemical conversion and associated deposition of cathode material.

5. A method as claimed in claim 1, characterized in that a body of a light and accurately formable material is used as a substrate, which material bonds poorly to the material deposited thereon or which can readily be detached from the resultant layer structure.

6. A method as claimed in claim 1, characterized in that the substrate is removed by selective etching, mechanically, by evaporation upon heating in a vacuum or in a suitable gas atmosphere, by burning off, or a combination of the said methods.

7. A method as claimed in claim 5, characterized in that a body of graphite, especially pyrolytic graphite, or glassy carbon, is used as a substrate which is removed by mechanical treatment, burning off and/or mechanical-chemical micropolishing.

8. A method as claimed in claim 5, characterized in that a body of copper, nickel, iron, molybdenum or an alloy with a major portion of said metals, is used as a substrate which is removed by selective etching or first for the greater part mechanically and in the remaining residues by evaporation upon heating in a vacuum or in a suitable gas atmosphere.

9. A method as claimed in claim 5, characterized in that a body of electrographite which is coated with a layer of pyrolytic graphite is used as a substrate.

10. A method as claimed in claim 1, characterized in that in the manufacture of the supporting layer a CVD layer growth method is used which is interrupted repeatedly by repeated substrate cooling to room temperature and restarting the nucleation by heating it up again, or a periodic variation of the substrate temperature is carried out in the range between 300° and 700° C.

11. A method as claimed in claim 1, characterized by the deposition of extremely thin, crystallite growth-inhibiting intermediate layers in the manufacture of the supporting layer.

12. A method as claimed in claim 1, characterized in that in the manufacture of the supporting layer, the base material is deposited together with a small admixture of a dopant which has a small or negligible solid solubility in the crystal lattice of the base material.

13. A method as claimed in claim 1, characterized in that tungsten is deposited as a base material and $ThO_2$, Zr, $ZrO_2$, $UO_2$, $Y_2O_3$, $Sc_2O_3$, Ru, Y and/or Sc in a concentration of approximately 0.5 to 2% by weight, especially approximately 1% by weight, are deposited simultaneously or alternatively with tungsten as structure-stabilizing dopings by a CVD method.

14. A method as claimed in claim 1, characterized in that in manufacturing the dispensing and supply region containing a high concentration of electron-emissive material, the emissive material is selected from the scandium group (Sc, Y, La, Ac, lanthanides, actinides) and is deposited in a metallic, oxide, boride and/or carbide form alternately or simultaneously with the high-melting metal.

15. A method as claimed in claim 1, characterized in that the following material combinations of electron-emissive material and high-melting metal are selected and deposited by a CVD method: $Th/ThO_2+W$, $Th/ThO_2+Nb$, $ThB_4+Re$, $Y/Y_2O_3+Ta$, $Y_2O_3+Nb$, $Y_2O_3+W$ or Mo, $Sc_2O_3+W$ or Mo, $La_2O_3+W$ or Mo.

16. A method as claimed in claim 1, characterized in that as electron-emissive materials lanthanide oxides, preferably $CeO_2$, $Sm_2O_3$ and $Eu_2O_3$ are deposited in combination with W or Mo as a base material or as a coating material.

17. A method as claimed in claim 15, characterized in that $ThB_4$ is deposited by pyrolysis of $Th(BH_4)_4$ which is transported by argon used as a carrier gas, upon a CVD layer of rhenium with an underlying structure-stabilized tungsten supporting layer at substrate temperatures higher than or equal to 300° C.

18. A method as claimed in claim 1, characterized in that the electron-emissive material is deposited in the oxide form together with an activator component, preferably boron or carbon, and with a diffusion intensifying component, preferably Pt, Ir, Os, Ru, Rh or Pd, in a concentration from 0.1 to 1% by weight.

19. A method as claimed in claim 1, characterized in that the reactive deposition and pyrolysis, respectively, is carried out at temperatures of the substrate from 200° C. to 600° C., preferably 400° to 550° C., in which as starting compounds for the electron-emissive material corresponding metallorganic compounds are used which are volatile even at these temperatures and the desired layer structure is obtained by repeated variation of the gas composition and/or the remaining deposition parameters.

20. A method as claimed in claim 15, characterized in that tungsten and thorium or $ThO_2$, respectively, is grown from the gaseous phase alternately or simultaneously from $WF_6+H_2$ and a Th-diketonate, especially Th-acetylacetonate, preferably Th-trifluoroacetylacetonate or Th-hexafluoroacetylacetonate, but also Th-heptafluorodimethyloctanedione or Th-dipivaloylmethane, at temperatures between 400° C. and 650° C. by reactive deposition from the gaseous phase, in which the metallorganic Th starting compound is present in powder form in a saturating device which is heated to a temperature closely below the relevant melting point and through which an inert gas, especially argon, flows as a carrier gas.

21. A method as claimed in claim 1, characterized in that the dispensing region with the store of electron-emissive material in the form of a series of layers is provided by CVD method on a structure-stabilized, doped CVD carrier layer of 30 to 300 μm thickness, especially 100 μm thickness, in which each time a layer of high-melting metal with small admixtures of electron-emissive material and optionally stabilizing dopings alternate with such a layer having high admixture concentrations which is slightly thinner, and the layer distances are in the order of the grain sizes, the individual layer thickness being especially 0.5 to 10 μm at a concentration of the emissive material up to 5% by weight and especially 0.1 to 2 μm at a concentration of the emissive material from 5 to 50% by weight, the average concentration of emissive material being preferably 15 to 20% by weight.

22. A method as claimed in claim 1, characterized in that a polycrystalline preferentially oriented coating layer is provided, the crystalline preferential orientation being adjusted by the parameters of a CVD deposition method, especially of the flow rates of the gases taking part in the deposition reaction and/or the substrate temperature in such manner that the electron emission current density from the substantially monoatomic film of the electron-emissive material on the coating layer at a given temperature becomes maximum and the work function becomes minimum, respectively, and the coating layer is texture-stabilized with respect to longer temperature loads by simultaneously deposited dopings not soluble therein.

23. A method as claimed in claim 1, characterized in that substantially W, Re, Os or Nb is provided as a surface coating layer, in which, in the case of tungsten with thorium as a monoatomic layer on the surface, the $<111<$ orientation of tungsten is adjusted as preferential orientation, and as texture-stabilizing component $ThO_2$, $ZrO_2$, $Y_2O_3$, $Sc_2O_3$ and/or ruthenium are also deposited simultaneously in a concentration from 0.5 to 2%.

24. A method as claimed in claim 1, characterized in that the coating layer has a thickness from 2 to 20 μm and the substrate temperature is adjusted so that the average grain diameter is $\leqq 1$ μm.

25. A method as claimed in claim 15, characterized in that emissive material and structure-stabilizing doping of the carrier material and coating layer material, respectively, are identical.

26. A method as claimed in claim 1, characterized in that the substrate is formed as a hollow body, preferably as a tube, especially of graphite, and the reactive deposition from the gaseous phase is carried out on the inside of the hollow body, the coating process occurring in a reversed time-sequence whereby, the preferred oriented polycrystalline coating layer is deposited first and the supporting layer is deposited last.

27. A method as claimed in claim 26, characterized in that the hollow body is of pyrolytic graphite and the cathode material has a linear coefficient of thermal expansion which is significantly larger than that of pyrolytic graphite (in the direction of coating) so that upon cooling to room temperature the cathode shrinks considerably more than the substrate of pyrolytic graphite and separates from the substrate and the cathode can be drawn out of the hollow body.

28. A method as claimed in claim 1, characterized in that the entire cathode is manufactured in one uninterrupted (continuous) manufacturing process by deposition from the gaseous phase.

29. A method as claimed in claim 1, characterized in that the layer structure is provided so that the three layers $\alpha$, $\beta$ and $\gamma$ are identical.

30. A thermionic cathode having a polycrystalline coating layer of high-melting metal which is deposited on underlying layers, manufactured by the method of claim 1, characterized in that the cathode comprises the following layers (a) a supporting layer of high-melting metal as a base material and at least one dopant for the mechanical structural stabilization, (b) a layer or series of layers acting during operation of the cathode as dispensing regions for the electron emissive material and consisting of high-melting metal as a base material and a supply of electron-emissive material, and (c) the polycrystalline coating layer or a preferentially oriented polycrystalline coating layer of high-melting metal as a base material and at least one dopant for the texture- and structure stabilization, the preferred orientation being so that the work function of the emitter monolayer on the coating layer is minimum.

* * * * *